US010843022B2

(12) United States Patent
Carnahan et al.

(10) Patent No.: US 10,843,022 B2
(45) Date of Patent: Nov. 24, 2020

(54) COLLAPSIBLE AND TRANSPORTABLE PARALLEL BARS FOR PHYSICAL THERAPY

(71) Applicant: CB Stability LLC, New Iberia, LA (US)

(72) Inventors: Kristin Carnahan, Chicago, IL (US); Hale Boudreaux, New Iberia, LA (US)

( * ) Notice: Subject to any disclaimer, the term of this patent is extended or adjusted under 35 U.S.C. 154(b) by 13 days.

(21) Appl. No.: 16/289,445

(22) Filed: Feb. 28, 2019

(65) Prior Publication Data

US 2019/0344111 A1 Nov. 14, 2019

Related U.S. Application Data

(63) Continuation of application No. 15/977,990, filed on May 11, 2018, now Pat. No. 10,252,095.

(51) Int. Cl.
*A63B 17/00* (2006.01)
*A63B 3/00* (2006.01)

(52) U.S. Cl.
CPC ..... *A63B 17/00* (2013.01); *A63B 3/00* (2013.01); *A63B 2210/50* (2013.01); *A63B 2225/09* (2013.01); *A63B 2225/093* (2013.01)

(58) Field of Classification Search
CPC ..... A61H 3/00; A61H 2003/001; A63B 1/00; A63B 3/00; A63B 17/00; A63B 17/02; A63B 17/04; A63B 22/0046; A63B 26/00; A63B 26/003; A63B 69/0028; A63B 69/0035; A63B 71/0009; A63B 71/0036; A63B 71/0054; A63B 71/02; A63B 71/023; A63B 2071/026; A63B 2071/027; A63B 2209/00; A63B 2209/02; A63B 2210/00;

(Continued)

(56) References Cited

U.S. PATENT DOCUMENTS 591,208 A 10/1897 Carrick
2,062,813 A 12/1936 Knourek (Continued)

*Primary Examiner* — Gary D Urbiel Goldner
(74) *Attorney, Agent, or Firm* — Law Office of Scott C Harris, Inc

(57) ABSTRACT

A portable parallel walking bar assembly is provided which is intended for use in a variety of settings due to the uniquely designed ability to rapidly assemble, disassemble, transport and store the apparatus when not in use. This particular design is made of five lightweight individual parts which may be assembled to form a stable support structure. Two of the segments are each of the parallel bars which in this design are collapsible in length and allow for variation in length. The bars extend to a length of 8.5 feet and collapse to a length of only 4 feet. The remaining three parts of the system are the support stanchions which the horizontal bars attach to for stabilization and their useful intended height of 24 to 40 inches. Each support stanchion consists of a flat cross-member, with beveled edge, which spans the width of the assembled system and provides the base of support. On both ends of each cross-member, a vertical support extends up and is adjustable in height. The vertical supports each connect to the horizontal rails in such a way that the assembled system is stable and secure for rehabilitation purposes, specifically for persons with physical disability to apply force through the rails to support their body weight as needed while walking.

14 Claims, 6 Drawing Sheets

(58) Field of Classification Search
CPC ..... A63B 2210/50; A63B 2210/58; A63B 2225/09; A63B 2225/093
See application file for complete search history.

(56) References Cited

U.S. PATENT DOCUMENTS

| | | | | | |
|---|---|---|---|---|---|
| 2,682,402 | A | | 6/1954 | McCarthy | |
| 2,690,789 | A | | 10/1954 | Zadrozny | |
| 2,808,873 | A | | 10/1957 | Snapp, Jr. | |
| 2,924,414 | A | | 2/1960 | Tesdal | |
| 3,071,204 | A | * | 1/1963 | Piltingsrud | E04G 1/00 182/27 |
| 3,120,386 | A | * | 2/1964 | Janssen | A63B 3/00 482/42 |
| 3,396,817 | A | | 8/1968 | Perry | |
| 3,556,254 | A | | 1/1971 | Lambert | |
| 3,929,330 | A | | 12/1975 | Cerasoli | |
| 3,948,513 | A | | 4/1976 | Pfotenhauer | |
| 4,094,330 | A | | 6/1978 | Jong | |
| 4,415,150 | A | * | 11/1983 | Iezza | A63B 3/00 211/182 |
| 4,620,612 | A | | 11/1986 | Enoki et al. | |
| 4,902,000 | A | | 2/1990 | Starks et al. | |
| 4,988,092 | A | | 1/1991 | Trout | |
| 5,024,601 | A | | 6/1991 | Barker | |
| 5,107,959 | A | * | 4/1992 | Lubinski | E04G 3/30 182/113 |
| 5,150,484 | A | * | 9/1992 | Whitten, Jr. | A47C 19/20 182/128 |
| 5,163,642 | A | * | 11/1992 | Torrens | F16L 3/00 248/49 |
| 5,720,697 | A | | 2/1998 | Winkel | |
| 5,924,960 | A | | 7/1999 | Cohen | |
| 5,941,800 | A | * | 8/1999 | Laconis | A63B 69/18 482/51 |
| 6,129,179 | A | * | 10/2000 | Rooney | E06C 1/38 182/156 |
| 6,168,548 | B1 | | 1/2001 | Fleming | |
| 6,238,320 | B1 | | 5/2001 | Flanagan | |
| 7,108,144 | B2 | | 9/2006 | Goodwin | |
| D605,721 | S | | 12/2009 | Simpson et al. | |
| D606,150 | S | * | 12/2009 | Simpson | A63B 3/00 D21/797 |
| 7,713,175 | B2 | | 5/2010 | Monaghan | |
| 8,876,666 | B1 | | 11/2014 | Palmer et al. | |
| 9,827,462 | B2 | | 11/2017 | Siqueira | |
| RE46,874 | E | | 5/2018 | D'Silva et al. | |
| 2004/0009845 | A1 | | 1/2004 | Johnson | |
| 2004/0132590 | A1 | | 7/2004 | Papas | |
| 2005/0181914 | A1 | | 8/2005 | Radkowski et al. | |
| 2008/0207405 | A1 | | 8/2008 | Jung | |
| 2010/0197465 | A1 | | 8/2010 | Stevenson | |
| 2014/0087920 | A1 | | 3/2014 | Nickel et al. | |
| 2014/0302968 | A1 | | 10/2014 | Velikin et al. | |
| 2015/0257965 | A1 | | 9/2015 | Simeone | |
| 2019/0344111 | A1 | * | 11/2019 | Carnahan | A63B 3/00 |

* cited by examiner

COLLAPSIBLE AND TRANSPORTABLE PARALLEL BARS FOR PHYSICAL THERAPY

This is a continuation of application Ser. No. 15/977,990, filed May 11, 2018, the entire contents of which are herewith incorporated by reference.

BACKGROUND

Walking rail assemblies have been used by individuals with lower extremity physical disability to provide support through the upper extremities to practice walking, regain balance, and build strength. The inventors recognized that many persons who could benefit from these devices can only use them in a physical therapy gym or rehabilitation hospital. This limitation is due to the size, weight and lack of ability to disassemble and re-assemble currently available products in any reasonable way.

There exists in today's market parallel bar assemblies that may be collapsed in place, but they do not achieve ease of assembly, disassembly and/or transportability. These devices operate to minimize their footprint when not in use. However, they still can be difficult to transport, use in various locations, and store. Most of the current devices of this type are indeed fixed in one location even if they can be folded or collapsed for the purpose of opening up floor space for other purposes as needed.

Other parties have described foldable parallel bars, but none of them include the advantages of the present system. The embodiments described herein include a base support with a surface of sufficiently low build height to allow ease of walking over the support for persons with physical disability who are primary users of the apparatus. Another improvement is a collapsible horizontal support rail, which minimizes significantly the space required for storage or transport of the 8' or 10' rails when disassembled and collapsed telescopically to achieve reduced length.

SUMMARY

Because the proposed invention achieves rapid ease of assembly, disassembly, and ability to transport the lightweight device in small segments, the apparatus may be transported and used in a patient's home either temporarily or permanently. The apparatus may also be utilized in a rehabilitation facility with portability to patient rooms or various locations within the facility as needed. Additionally, the apparatus may be disassembled and stored in any location when not in use, due to its compact footprint when collapsed and diassembled.

A portable parallel walking bar assembly is provided which is intended for use in a variety of settings due to the uniquely designed ability to rapidly assemble, disassemble, transport and store the apparatus when not in use. In the disassembled state, the design is made of five lightweight individual parts which may be assembled to form a stable support structure. Two of the segments are each of the parallel bars which are collapsible in length and allow for variation in length. The bars extend to a length of 8.5 feet and collapse to a length of only 4 feet.

The remaining three parts of the system are the support stanchions which the horizontal bars attach to for stabilization and their useful intended height of 24 to 40 inches. Each support stanchion consists of a flat cross-member, with beveled edge, which spans the width of the assembled system and provides the base of support. On both ends of each cross-member, a vertical support extends up and is adjustable in height. The vertical supports each connect to the horizontal rails in such a way that the assembled system is stable and secure for rehabilitation purposes, specifically for persons with physical disability to apply force through the rails to support their body weight as needed while walking.

Right angle interface connectors connect between the support stanchions and the horizontal bars. All the parts are connectable using snap pins and in some cases locking screws.

DETAILED DESCRIPTION

Embodiments are as described herein.

The present invention is unique in its design and functional capacity to allow users to benefit from the device in a broad scope of locations, not limited any longer by location of available fixed walking rails at specific rehabilitation facilities. Moreover, within a specific facility, the location of the walking rails can be changed with minimal effort on the part of the therapist or other employee. This capability moves beyond the currently available ability to reduce the footprint of the device by allowing for disassembly, transport, and re-assembly with minimal effort.

Specifically, this device is formed of five separate components which can be assembled to form one set of waking rails of sufficient stability for a person with lower extremity disability to use during rehabilitation therapy.

Three of the components are support stanchions 100, 102, 104 which provide the base of support against the floor as well as adjustable uprights which receive the attachment of the remaining two horizontal rails. Each support stanchion has a base plate with a fixed dimension sufficient to allow a person to walk between the upright supports. The thickness of the base plate is sufficient to prevent flexibility yet thin enough to allow a person with disability to step on or over the plate during use of the rails. The base plate has an attachment on the underside made of an elastomeric material, to increase friction against the floor and prevent sliding of the stanchions on smooth surfaces.

The stanchions are each supported with a laterally angled beam 215 welded to the base support to prevent lateral deflection of the uprights under load from a user who is applying weight both downward and outward through their arms.

The uprights are of telescopic design to allow for a small dimension to be achieved when disassembled for transport and a full adjustable height of 24 to 40 inches during use. Each support structure has a receiving attachment at the proximal aspect so that the horizontal rails may be attached with ease.

The two remaining components are the collapsible horizontal rails 110, 112. These two rails are the primary useful component of the walking rail assembly as they are the components to which a user applies force during rehabilitation exercises. No existing product of this kind offers a set of rails that are collapsible in nature to allow ease of disassembly for transport or storage. The two horizontal rails 110, 112 are telescopic in design just like the uprights on the support stanchions 100. The rails can actually be attached to support stanchions when not fully extended if shorter length is desired. The fully extended length is 96 inches in one embodiment. The horizontal rails may be attached to the support stanchions at three separate locations, on each end and at the midpoint, allowing for secure assembly of the rails to the support stanchion during use of the apparatus.

Figure 1:
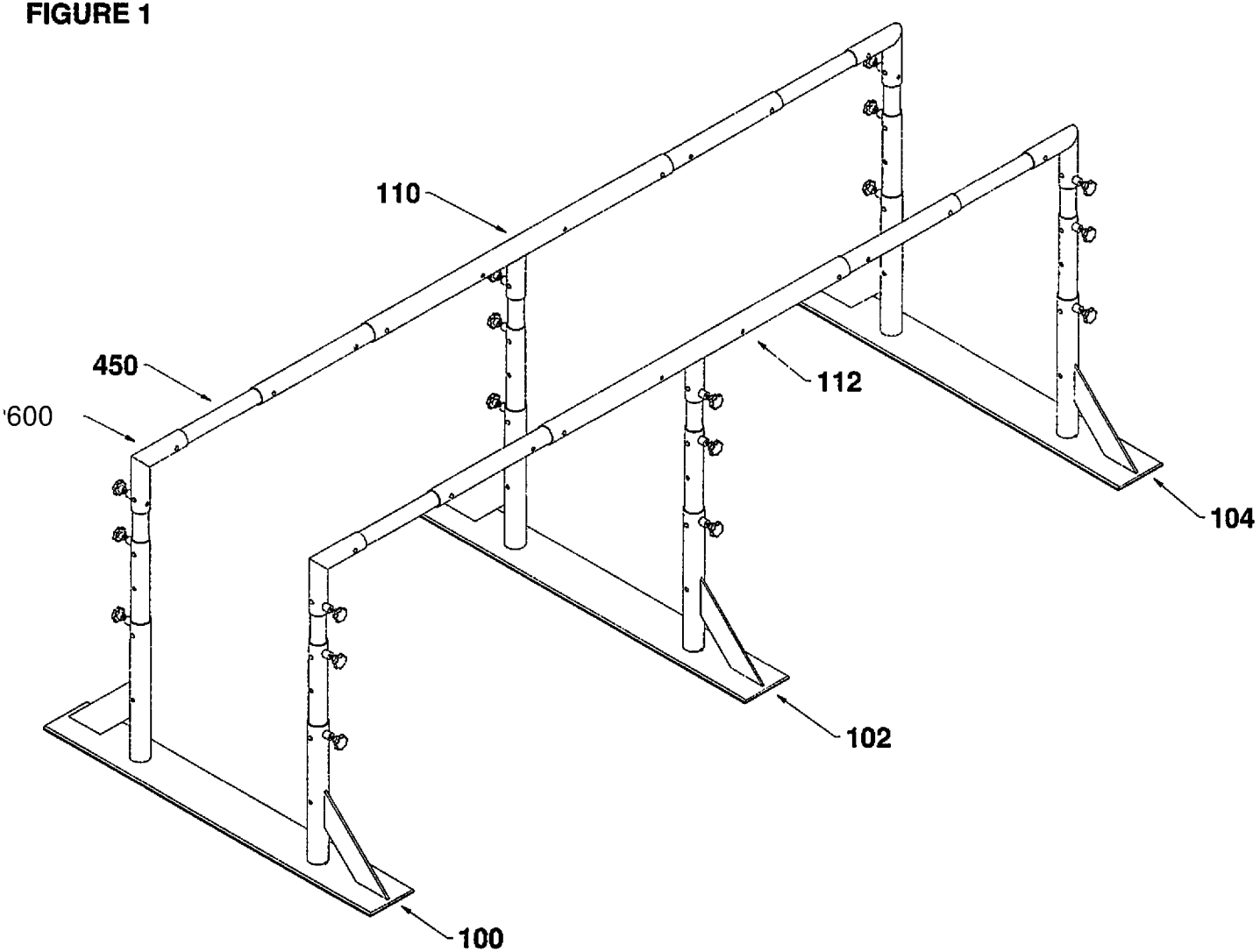
FIG. 1 is a perspective view of the fully assembled walking rail apparatus.

FIG. 1 illustrates an embodiment showing all of the different parts as they are assembled together. The device is formed of stanchions 100, 102 and 104 connected to and supporting horizontal rails 110 and 112. Both the stanchions 100 and the horizontal rails 110 are collapsible, and are easily extended so that the parallel bars can be easily moved from place to place, stored, and easily assembled.

Figure 2:
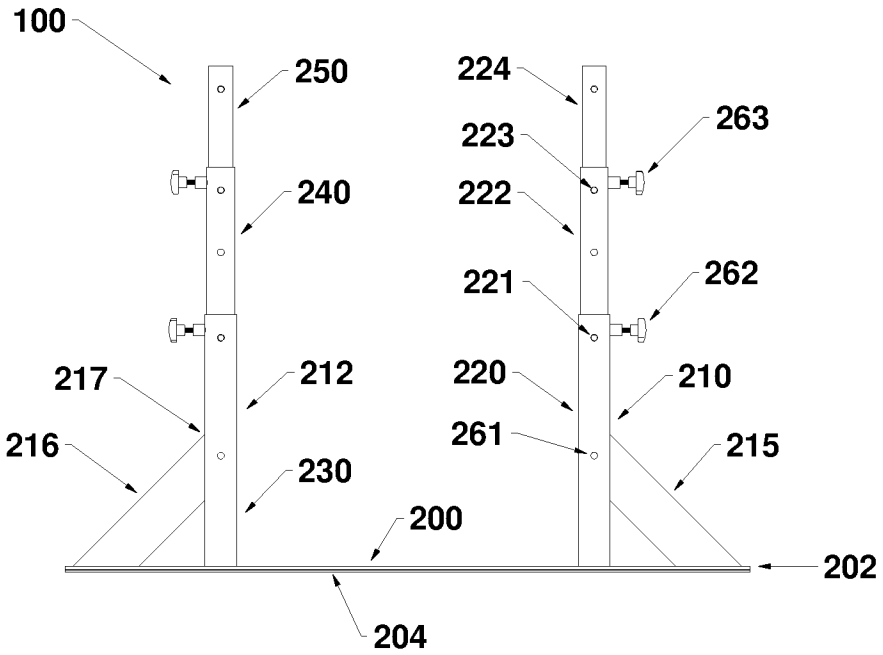
FIG. 2 is a front on view of the stanchion in its extended position.
Figure 3:
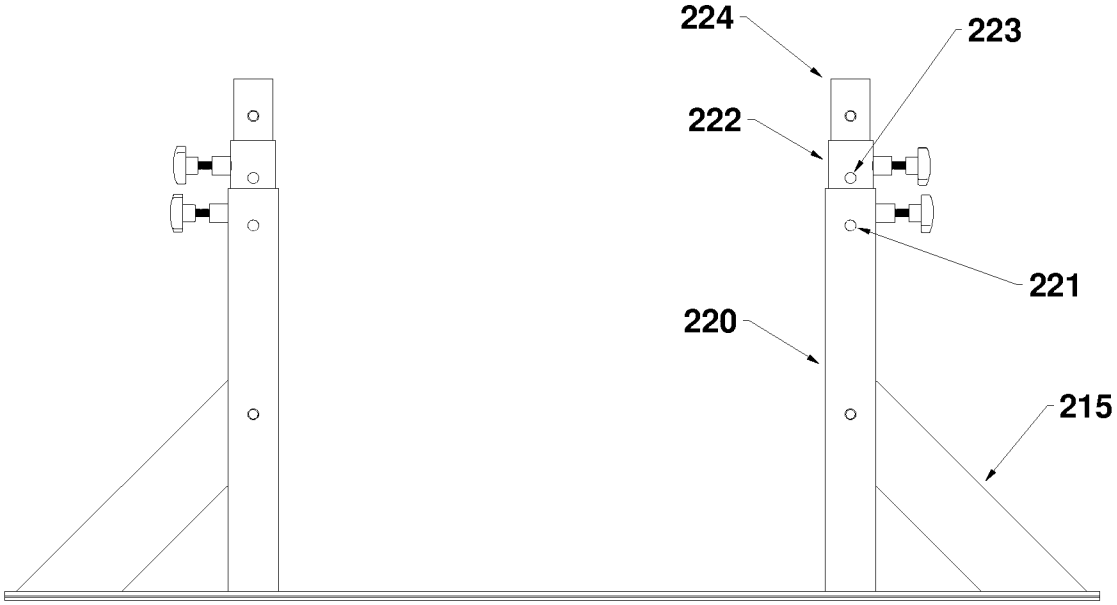
FIG. 3 is a front on view of the stanchion in its collapsed position.

The stanchions such as 100 are shown in further detail in FIGS. 2 and 3. The stanchions are specifically formed of a base plate 200 which is formed of a metal material 202 covered with an elastomeric covering 204 to increase friction against the floor. The base plate 200 is connected to uprights such as 210, 212 each of which are substantially perpendicular to the surface of the base plate 200. There are also angular supports or laterally angled beams 215, 216 that are welded between the base plate 200 and a connection position 217 which is substantially halfway up the base plate of the upright.

The uprights themselves are formed of three nesting and telescoping parts where the outer surface of each smaller part nests within the inner surface of each larger part. The main base 220 is the widest, and at its top portion includes a hole that receives the pin from double headed spring loaded push pin 221 (henceforth "push pin") which snaps from the middle part 222. The push pins are pushed to open the specific push pin to allow movement of the telescoping parts such as 222, 224, and snap into place to hold the middle base 222 in place in the extended position. There are also locking screws 262, 263 that can be tightened for additional security once the part is fully extended. The surfaces of the locking screws 262, 263 also prevents the middle part 222 from collapsing beyond its maximum collapsed position shown in FIG. 3.

The middle base 222 is thinner than the main base, and its outer surface nests within the inner surface of the main base 220. The middle base 222 can slide out to its extended portion shown in FIG. 2 held by the push pins; and slide back into its collapsed position shown in FIG. 3. Similarly, the top base 224 is easily movable to its position of maximum telescoping shown in FIG. 2 held by the push pin 223, and extends inward to its collapsed position shown in FIG. 3.

In one embodiment, the locking screws 262, 263 on the uprights can be used as a safety measure to back up to the push pin. If for any reason a push pin would break, the locking screws could add a second level of safety.

The upright 212 similarly has a lower portion 230, middle base 240 and upper portion 250 similar to that in the upright 210. Both uprights can collapse downward to their fully collapsed position as shown in FIG. 3.

The three uprights when placed together as shown in FIG. 1 can support first and second horizontal rails 110,112, which form one set of walking rails of sufficient stability for a person with lower extremity disability to use during rehabilitation therapy.

Figure 4:
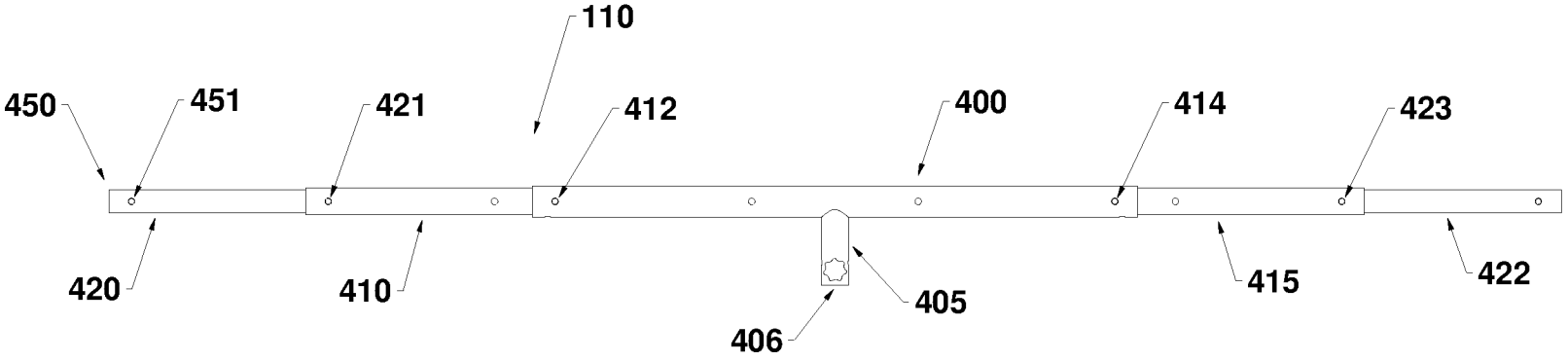
FIG. 4 is a view of the horizontal rail in its fully extended state.
Figure 5:
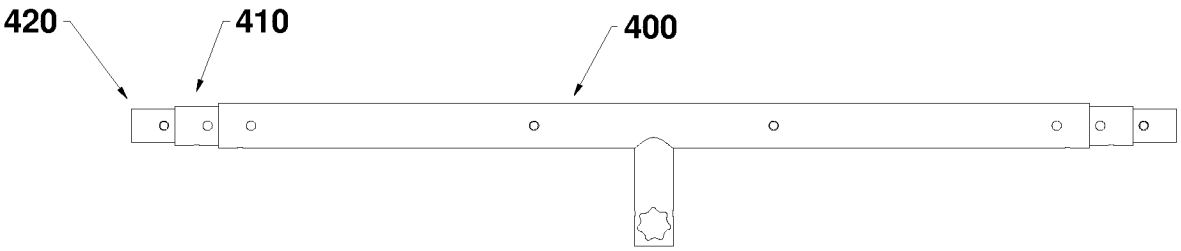
FIG. 5 is a view of the horizontal rail in its collapsed state.

As with the upright supports, the horizontal rails are fully telescopic in operation. FIGS. 4 and 5 illustrate the telescoping operation of the horizontal rails such as 450. The rail 110 is shown in FIG. 4 in its fully extended position. This rail includes a main metal middle bar portion 400 which is welded at a substantially central portion to a right angle-facing attachment part 405 which is sized to have inner surfaces that fit over the outer surfaces of the top base 224 of the stanchion. The attachment part 405 also includes a locking screw 406, that can be tightened to lock the horizontal rail to the base piece such as 210. The attachment part 405 has inside surfaces which are of a size to receive the outside surface of the upper portion 224 of one of the support stanchions. In this way, the center support stanchion can be connected to the attachment part 405, with the outer surfaces of the rail portion 224 placed within the inner surfaces of the attachment part 405, and tightened into place by locking screw 406.

Two extending lateral portions 410, 415 are telescopically held within the inner surfaces of the central portion 400. Each of those extending lateral portions telescope out of the inner surfaces in opposite directions to one another. The two extending lateral portions 410, 415 are secured into place in their extended positions respectively by the push pins 412, 414.

Similarly, there are two additional laterally extending portions 420, 422 which can be extended as shown in FIG. 4, or collapsed as shown in FIG. 5. When extended, the push pin 421 is snapped into place to hold the extension in place and similarly the push pin 423 is snapped in to hold that other side extension into place.

When collapsed, as shown in FIG. 5, the outside surface of the distal laterally extending portions such as 420 fit within the inside surface of the mid-laterally extending portion such as 410 which fit within the inside surface of the central portion 400.

Figure 6:
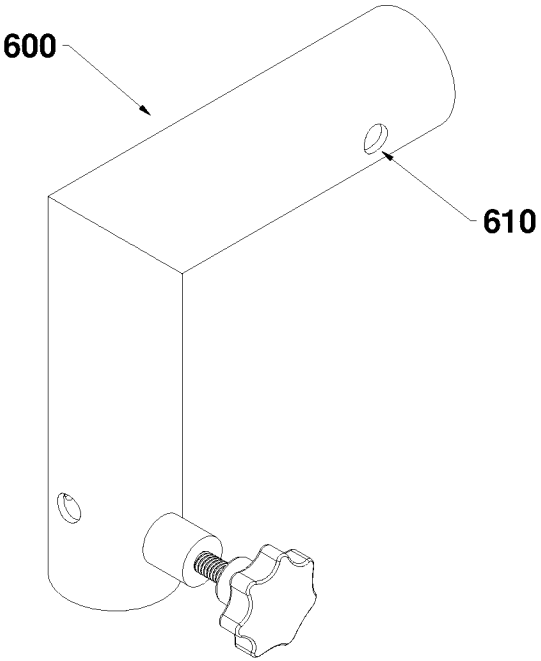
FIG. 6 shows the right angle interface part.

FIG. 6 shows the right angle members 600 which connect between the distal ends such as 420 of the horizontal rails, and distal end such as 250 of the support stanchions. These are right angle members, which connect between the horizontal members going in a first direction, and the support members going in a second orthogonal direction. The right angle members 600 have inner surfaces that fit over the outer surfaces of the extending portions such as 420 and the extending portions such as 250.

In operation, each of the stanchions and the horizontal members can each be telescoped down to their full collapsed positions. This leaves five different collapsed parts, which in an embodiment can be less than 60 pounds total. Between those five parts, and four of the right angle connectors, this can be easily transported in a relatively small space. To assemble, the stanchions are put into place, and pulled up to their fully extended positions. This only requires pulling up the horizontals, until the push pins snap into place. Two of the stanchions can be transported with the right angle connectors attached thereto. If desired, the locking screws 262, 263 can be tightened on the uprights. Then, the middle horizontal bar is placed onto the middle stanchion, and the locking screw 406 is tightened. Each horizontal piece is extended, until it fits into the respective right angle connector 600, on each of the stanchions. These parts snap into place when the snap pin 451 at the end of the piece 420 snaps into the corresponding hole 610 in the right angle connector 600.

In another embodiment, the right angle connectors can be attached to either the horizontal members or the stanchions, either permanently or temporarily.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art. For example, other sizes can be used, and different connection techniques can be used other than the push pins. A preferred material for the bars is aluminum, however, the product could be made of steel (heavier) or carbon fiber (lighter, but more expensive). We would like to protect the design from other material variations if possible.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A parallel bar assembly, comprising:

first and second horizontal extending members, each of the first and second horizontal extending members is adjustable between a fully extended position in which each of the first and second horizontal extending members respectively have a maximum length and a non-extended position in which each of the first and second horizontal extending members respectively take up less than the maximum length, each of the first and second horizontal extending members including multiple portions that attach to one another in the fully extended position, the multiple portions including at least first, second and third horizontal portions which connect to one another in the fully extended position, and which form shorter areas in the non-extended position;

first and second support stanchions, which provide support in a vertical direction, which each extend between a collapsed position and an extended position, the first and second support stanchions including outer surfaces and a holding mechanism for releasably and respectively holding the outer surfaces in the extended position with structure that locks the outer surfaces in the extended position; and connection mechanisms which respectively connect the first and second support stanchions to first and second locations of the first and second horizontal extending members, respectively, wherein the first and second locations and the first and second horizontal extending members are spaced apart from each other; wherein the connection mechanisms each respectively connect at a right angle between a direction of the first and second horizontal extending members and a direction of the first and second support stanchions wherein the first and second support stanchions extend in the vertical direction.

2. The parallel bar assembly as in claim 1 wherein at least one of the connection mechanisms connects to one of the first and second horizontal extending members in a location where the one of the first and second horizontal extending members extends on both sides of the at least one connection mechanism, and the one of the first and second horizontal extending members extends in first and second directions relative to the at least one connection mechanism.

3. The parallel bar assembly as in claim 2 wherein the at least one of the connection mechanisms is welded to the one of the first and second horizontal extending members in the location where the one of the first and second horizontal extending members extends on both sides of the at least one of the connection mechanisms.

4. The parallel bar assembly as in claim 2, further comprising holding mechanisms which hold the first and second horizontal extending members and the first and second support stanchions in the fully extended positions and the extended positions, respectively.

5. The parallel bar assembly as in claim 4, wherein the holding mechanisms include locking pins.

6. The parallel bar assembly as in claim 4, wherein the holding mechanisms include double headed spring loaded push pins.

7. The parallel bar assembly as in claim 1, wherein the first and second horizontal extending members and the first and second support stanchions are formed of cylindrical pipes.

8. The parallel bar assembly as in claim 7, wherein the cylindrical pipes are formed of metal.

9. The parallel bar assembly as in claim 1, wherein the first and second support stanchions include a first member supporting the first horizontal extending member, and a second member supporting the second horizontal extending member.

10. The parallel bar assembly as in claim 9, wherein a bottom base extends between and under the first and second members and between the first and second members and a ground surface, the first and second support stanchions each including an angle support that supports between the bottom base and a location respectively on each of the first and second members and spaced from the ground surface.

11. The parallel bar assembly as in claim 1, wherein the multiple portions of the first and second horizontal extending members fit at least partially within one another in the non-extended position.

12. A parallel bar assembly, comprising:

first and second horizontal extending members, each of the first and second horizontal extending members including multiple portions with surfaces that attach to one another in a fully extended position in which each of the first and second horizontal extending members respectively extends over a maximum length thereof;

wherein the multiple portions of the first and second horizontal extending members detach from one another into a collapsed state in which the multiple portions of the first and second horizontal extending members, respectively, are not attached to one another, and wherein each of the first and second horizontal extending members respectively extends over less than the maximum length thereof;

first and second support stanchions, which respectively provide support to the first and second horizontal extending members, the first and second support stanchions extending in a vertical direction;

and connection mechanisms, which respectively connect the first and second support stanchions to first and second locations of the first and second horizontal extending members, respectively, wherein the first and second locations and the first and second horizontal extending members are spaced apart from each other, wherein the connection mechanisms each respectively connect at a right angle between a horizontal direction of the first and second horizontal extending members and the vertical direction of the first and second support stanchions, and where at least one of the connection mechanisms has a T shape to connect to one of the first and second horizontal extending members in a location where the one of the first and second horizontal extending members extends in first and second directions relative to the at least one connection mechanism.

13. The parallel bar assembly as in claim 12, wherein the at least one of the connection mechanisms that has the T shape is permanently attached to the one of the first and second horizontal extending members.

14. The parallel bar assembly as in claim 13, wherein the at least one of the connection mechanisms that has the T shape is welded to the one of the first and second horizontal extending members.

* * * * *